US006746338B1

(12) United States Patent
Keaton

(10) Patent No.: US 6,746,338 B1
(45) Date of Patent: Jun. 8, 2004

(54) ANGULARLY ADJUSTABLE PUTTING PRACTICE APPARATUS

(76) Inventor: Tommy Lee Keaton, 1122 Victoria, Waco, TX (US) 76705

( * ) Notice: Subject to any disclaimer, the term of this patent is extended or adjusted under 35 U.S.C. 154(b) by 0 days.

(21) Appl. No.: 10/334,236

(22) Filed: Dec. 31, 2002

(51) Int. Cl.[7] ..... A63B 69/36
(52) U.S. Cl. ..... 473/160; 473/162
(58) Field of Search ..... 473/160–161, 473/162, 163, 279

(56) References Cited

U.S. PATENT DOCUMENTS

| | | | | | |
|---|---|---|---|---|---|
| 1,676,804 | A | * | 7/1928 | Scheck | 473/158 |
| 3,424,463 | A | * | 1/1969 | Matthews | 473/163 |
| 3,831,949 | A | * | 8/1974 | Henning | 473/158 |
| 3,871,661 | A | * | 3/1975 | Korff | 473/160 |
| 4,240,637 | A | * | 12/1980 | Cross et al. | 473/160 |
| 5,067,716 | A | * | 11/1991 | Namanny et al. | 473/158 |
| 5,123,651 | A | * | 6/1992 | Vinciguerra | 473/163 |
| 5,171,016 | A | * | 12/1992 | Kamal | 473/160 |
| 5,390,925 | A | | 2/1995 | Wiltse | 273/176 H |
| 5,445,381 | A | | 8/1995 | Van Ert | 273/176 H |
| 5,529,304 | A | * | 6/1996 | Wood | 473/163 |
| 5,855,522 | A | | 1/1999 | Bevan | 473/160 |
| 5,863,256 | A | | 1/1999 | MacLean et al. | 473/160 |
| 6,062,984 | A | * | 5/2000 | Ju | 473/160 |
| 6,146,284 | A | | 11/2000 | Russell | 473/160 |
| 6,152,830 | A | * | 11/2000 | Archie | 473/160 |

* cited by examiner

*Primary Examiner*—Mark S. Graham
(74) *Attorney, Agent, or Firm*—Sturm & Fix LLP

(57) ABSTRACT

A putting practice apparatus (10) including an elongated generally rectangular framework member (20) that supports a putting surface unit (12) including a raised platform member (30) having a simulated grass surface (31) and a cup aperture (32) disposed proximate one end wherein, a ball return pipe (36) and branched ball return pipe segment (37) are operatively associated with the putting surface unit (12) and four screw jack members (40) are disposed adjacent the four corners of the framework member (20) to selectively provide uphill, downhill, right- and left-hand side hill orientations to the raised platform member (30).

5 Claims, 1 Drawing Sheet

Fig. 1
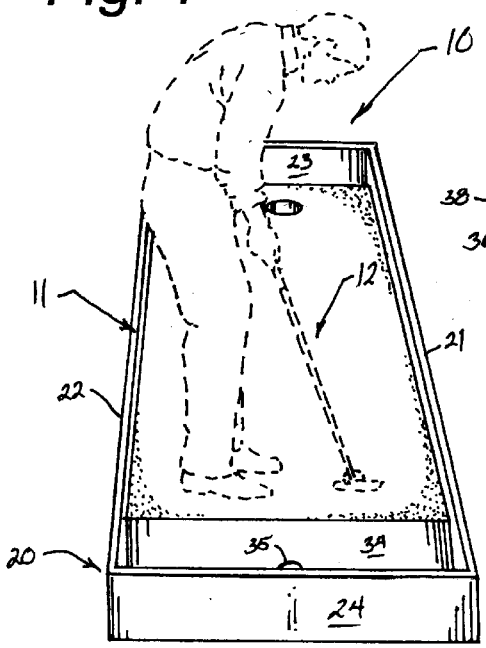
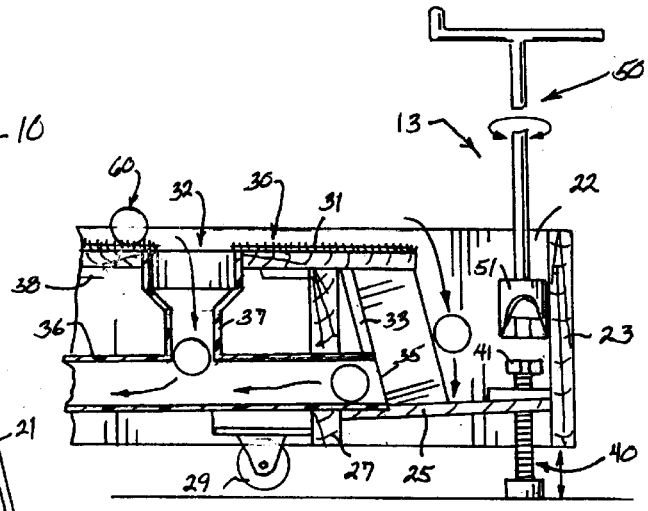
Fig. 4
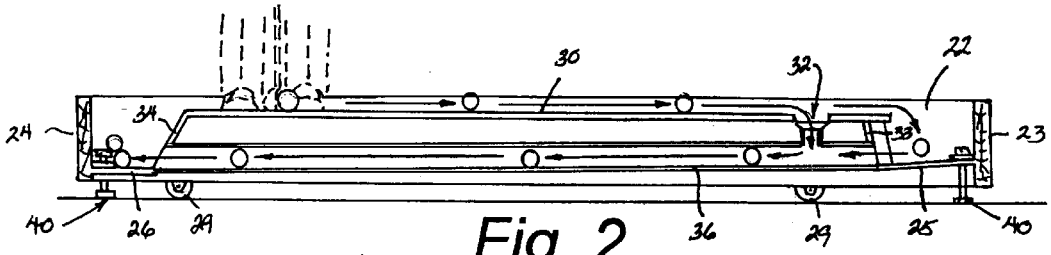
Fig. 2
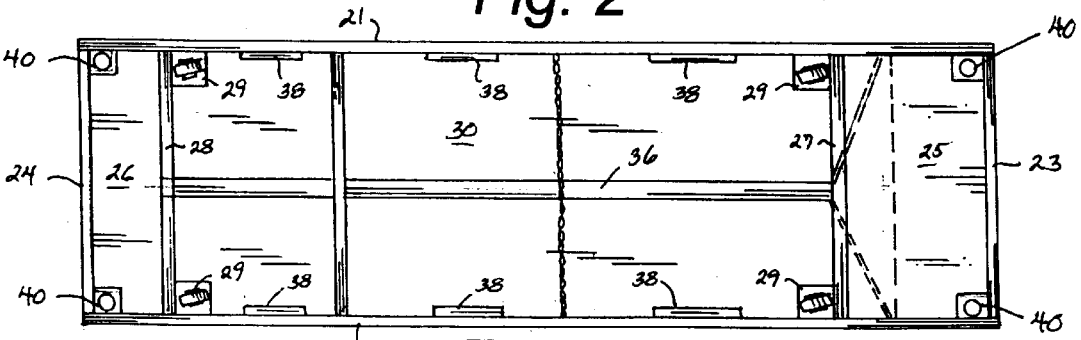
Fig. 3

ANGULARLY ADJUSTABLE PUTTING PRACTICE APPARATUS

CROSS REFERENCE TO RELATED APPLICATIONS

Not applicable.

BACKGROUND OF THE INVENTION

1. Field of the Invention

The present invention relates to the field of putting practice devices in general and in particular to an angularly adjustable putting practice apparatus.

2. Description of Related Art

As can be seen by reference to the following U.S. Pat. Nos. 6,146,284; 5,863,256; 5,855,522; 5,445,381; and, 5,390,925, the prior art is replete with myriad and diverse putting practice devices.

While all of the aforementioned prior art constructions are more than adequate for the basic purpose and function for which they have been specifically designed, they are uniformly deficient with respect to their failure to provide a simple, efficient, and practical putting practice apparatus that is incrementally angularly adjustable to provide uphill, downhill and side hill dispositions of the golf hole relative to the golfer.

As most golfers are all too well aware, hardly any conventional golf course greens are perfectly flat which renders most putting practice devices relatively useless due to their inability to simulate actual putting conditions.

As a consequence of the foregoing situation, there has existed a longstanding need among golfers for a new and improved angularly adjustable putting practice apparatus that can at least approximate conditions that the golfer would encounter on a real golf course, and the provision of such an apparatus is the stated objective of the present invention.

BRIEF SUMMARY OF THE INVENTION

Briefly stated, the putting practice apparatus that forms the basis of the present invention comprises in general a framework unit, a putting surface unit and an adjustment unit that can incrementally adjust the angular orientation of the framework unit relative to a horizontal support surface.

As will be explained in greater detail further on in the specification, the framework unit includes an elongated rectangular framework member which surrounds and supports a raised putting surface platform member having a cup aperture and a branched ball return pipe member which guides a golf ball entering the cup aperture of the platform member or landing on a front floor panel segment of the framework member to a rear floor panel segment of the framework member.

In addition, the adjustment unit includes four screw jack members disposed adjacent to the four corners of the framework member wherein, the screw jack members are independently actuatable to give the platform member a variable angular orientation ranging between an uphill lie, a downhill lie, a right-handed or left-handed side hill lie so that the golfer can practice putts corresponding to actual putting conditions on a golf course.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the putting practice apparatus in use;

FIG. 2 is a side cross-sectional elevation view of the apparatus;

FIG. 3 is a bottom plan view of the apparatus; and,

FIG. 4 is an isolated cross-sectional detail view of the distal end of the putting practice apparatus.

DETAILED DESCRIPTION OF THE INVENTION

As can be seen by reference to the drawings, and in particular to FIG. 1, the putting practice apparatus that forms the basis of the present invention is designated generally by the reference number 10. The apparatus 10 comprises in general a framework unit 11, a putting surface unit 12, and an adjustment unit 13. These units will now be described in seriatim fashion.

As shown in FIGS. 1 through 3, the framework unit comprises an elongated rectangular framework member 20 having elongated opposed sidewalls 21 22 that are connected to one another by a front wall 23 and a rear wall 24 wherein, the front wall 23 is provided with a contoured floor panel segment 25 and the rear wall 24 is provided with a generally flat floor panel segment 26 and the floor panel segments 25 26 are further supported by cross-braces 27 and 28 which extend between the opposed sidewalls 21 22.

In addition, as shown in FIGS. 3 and 4, each of the cross-braces 27 and 28 is provided with a pair of roller wheel assemblies 29 disposed at the opposite ends of each cross-brace 27 and 28 such that the wheel assemblies are spaced inwardly from the front 23 and rear 24 walls of the framework member 20.

Turning now to FIGS. 2 through 4, it can be seen that the putting surface unit 12 comprises an elongated rectangular platform member 30 provided with a simulated grass surface 31 and having a regulation sized cup aperture 32 provided proximate the distal end of the platform member 30 wherein, the distal and proximal ends of the platform member 30 are provided with angled front 33 support and rear 34 panels each provided with a ball return aperture 35 that is in open communication with an elongated ball return pipe 36 extending between the apertures 35 and further provided with a branched pipe segment 37 that is connected to the cup aperture 32 in the platform member 30.

In addition, as can best be seen by reference to FIGS. 3 and 4, the platform member 30 is further supported in an elevated position relative to the front 25 and rear 26 floor panel segments and spaced from the front 23 and rear 24 walls of the framework member 20 by a plurality of discrete shelf elements 38 which extend outwardly from the opposed sidewalls 21 22 to support the underside of the platform member 30.

As shown in FIGS. 2 through 4, the adjustment unit 13 comprises a plurality of screw jack members 40 disposed at the four corners of the framework member 20 wherein, the screw jack members 40 have an enlarged head 41 adapted to be engaged by the socket head 51 of a long stemmed socket wrench element 50 to vary the individual effective height of each screw jack member 40 relative to the framework member 20 such that the putting platform member 30 can be disposed in an uphill, downhill, as well as, a right or left-handed breaking side hill disposition to present different challenges to the golfer.

Turning now in particular to FIGS. 2 and 3, it can be appreciated that the front floor panel segment 25 is raised above the height of the rear floor panel segment 26 and contoured such that any golf ball 60 landing on the contoured front floor panel segment 25 will be directed by gravity into the ball return pipe 36 for delivery to the rear floor panel segment 26 in a well recognized manner.

Furthermore, as can be appreciated by reference to FIGS. 2 and 4, the screw jack members 40 may be retracted such that the wheel assemblies 29 can be employed to move the apparatus 10 to a desired location.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein; is only to be limited to the extent of the breadth and scope of the appended claims.

I claim:

1. A putting practice apparatus comprising:

a framework unit including a generally elongated rectangular framework member having a pair of opposed sidewalls, a front wall, a rear wall, a contoured front floor panel segment associated with the front wall, a generally flat rear floor panel segment associated with the rear wall, and a plurality of wheel assemblies spaced inwardly from said front and rear walls;

a putting surface unit including a generally elongated rectangular platform member having a proximal end spaced from said rear wall and a distal end spaced from said front wall of the framework member wherein, a cup aperture is disposed proximate the distal end of the platform member, and the platform member is elevated relative to the front and rear floor panel segments of the framework member; and, means for independently raising and lowering the four corners of the framework member relative to a horizontal surface wherein, said means includes four screw jack members disposed adjacent the four corners of the framework member wherein, the screw jack members have an effective length greater than the height of said wheel assemblies.

2. The apparatus as in claim 1; wherein, the platform member is provided with a simulated grass surface.

3. The apparatus as in claim 2; wherein, the front floor panel segment is elevated relative to the rear floor panel segment.

4. The apparatus as in claim 3; wherein, the putting surface unit is further provided with front and rear support panels each provided with a ball return aperture and an elongated ball return pipe in open communication with said ball return apertures.

5. The apparatus as in claim 4; wherein, said elongated ball return pipe is further provided with a branched pipe segment in open communication with said cup aperture.

* * * * *